US005368178A

United States Patent [19]

Towns et al.

[11] Patent Number: 5,368,178

[45] Date of Patent: Nov. 29, 1994

[54] CONTAINER AND CLOSURE THEREFORE HAVING CONICAL SEALING SURFACES

[76] Inventors: Edward J. Towns, 13401 Hackamore Dr., Matthews, N.C. 28105; Edward M. Brown, 128 Passaic Ave., Livingston, N.J. 07039

[21] Appl. No.: 848,228

[22] Filed: Mar. 9, 1992

[51] Int. Cl.[5] ..... B65D 41/16

[52] U.S. Cl. ..... 215/317; 215/316; 215/321; 220/306; 220/356

[58] Field of Search ..... 215/316, 224, 302, 303, 215/304, 317, 321, 324; 220/306

[56] References Cited

U.S. PATENT DOCUMENTS

| | | | |
|---|---|---|---|
| 3,434,614 | 3/1969 | Moller | 215/224 |
| 3,556,338 | 1/1971 | Wilkinson et al. | 215/320 X |
| 3,592,349 | 7/1971 | Baugh | 215/354 X |
| 3,651,972 | 3/1972 | Itoh | 215/321 X |
| 3,830,393 | 8/1974 | Schaefer | 215/224 X |
| 3,934,745 | 1/1976 | Lovell | 215/224 |
| 4,333,578 | 6/1982 | DiNunzio | 215/253 |
| 4,356,930 | 11/1982 | Roper | 220/306 |
| 4,444,332 | 4/1984 | Widën et al. | 220/306 |
| 4,574,974 | 3/1986 | von Holdt | 220/306 |
| 4,640,435 | 2/1987 | Dutt | 220/307 |
| 5,103,990 | 4/1992 | Irwin | 215/320 |

*Primary Examiner*—Allan N. Shoap
*Assistant Examiner*—Vanessa Caretto
*Attorney, Agent, or Firm*—Charles E. Temko

[57] ABSTRACT

An improved container and closure therefore particularly adapted for use in storing pressurized liquid contents, such as carbonated beverages. As contrasted with conventional crown seals which employ a sealing gasket, the closure effects a sealing action between corresponding frustoconical sealing surfaces on the container finish and an inner surface of the cap, thus eliminating the need for a gasket. The closure includes a tamper indicating means at a lower peripheral edge thereof which is damaged upon engagement with an opening tool or other object.

1 Claim, 2 Drawing Sheets

CONTAINER AND CLOSURE THEREFORE HAVING CONICAL SEALING SURFACES

BACKGROUND OF THE INVENTION

This invention relates generally to the field of disposable small volume containers particularly adapted to contain liquids under pressure such as beer and carbonated soft drinks. More particularly it relates to an improved bottle finish and closure therefore adapted to avoid the long standing disadvantages of the metal crown closure commonly used in such applications.

Although considerations of cost are not without importance, the principal requirement for a closure of this type is the ability to maintain pressure within the container over extended periods of time, coupled with the ability to be readily opened in a manner which bleeds excess pressure during the opening operation, so as to void the problem often encountered, for example, when removing a champagne cork. The crown type cap, in cooperation with a glass container has performed reasonably well in this regard, but has not proved effective where the container is formed from less rigid materials.

SUMMARY OF THE INVENTION

Briefly stated, the invention contemplates the provision of an improved combination synthetic resinous container and closure therefore particularly suited for use as a relatively small volume beverage container.

To this end, the container neck or finish is provided with an outer annular surface having a closure retaining groove which engages a corresponding retaining bead on an inner surface of the annular side wall of the closure. Extending downwardly from the bead is a tapered skirt which is engaged by a conventional opening tool. The closure includes a relatively thin end wall which is impervious, but which also does not provide substantial sealing. Instead, the portion of the neck or finish above the closure retaining groove includes a tapered frustoconical surface. The inner surface of the side wall of the closure is correspondingly configured, and slightly undersized to form an interference with the bottle finish when pressed into position. This interface provides the entire sealing action between the container and the closure. When the closure is removed, bleeding of excess pressure is accomplished at an early stage of removal as the side wall of the closure is stretched by the opening tool.

DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
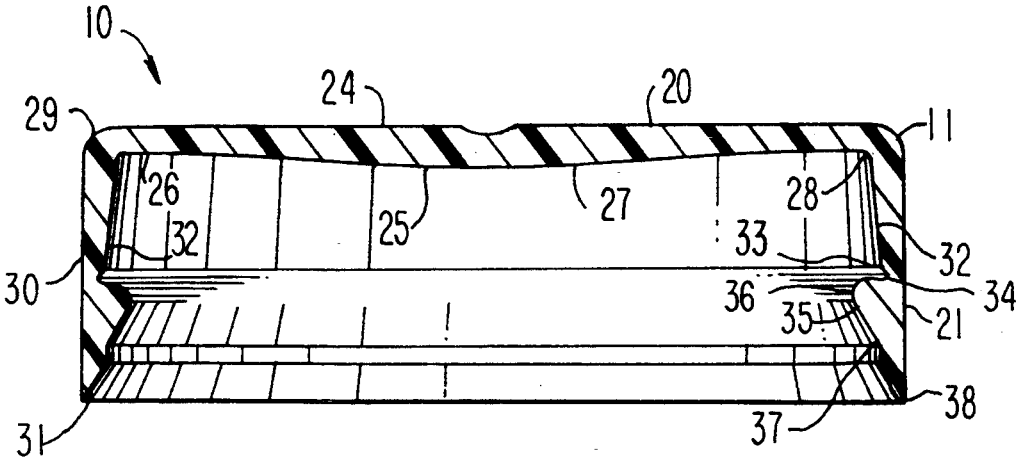
FIG. 1 is a vertical central sectional view of a closure element forming part of a disclosed embodiment of the invention.
Figure 2:
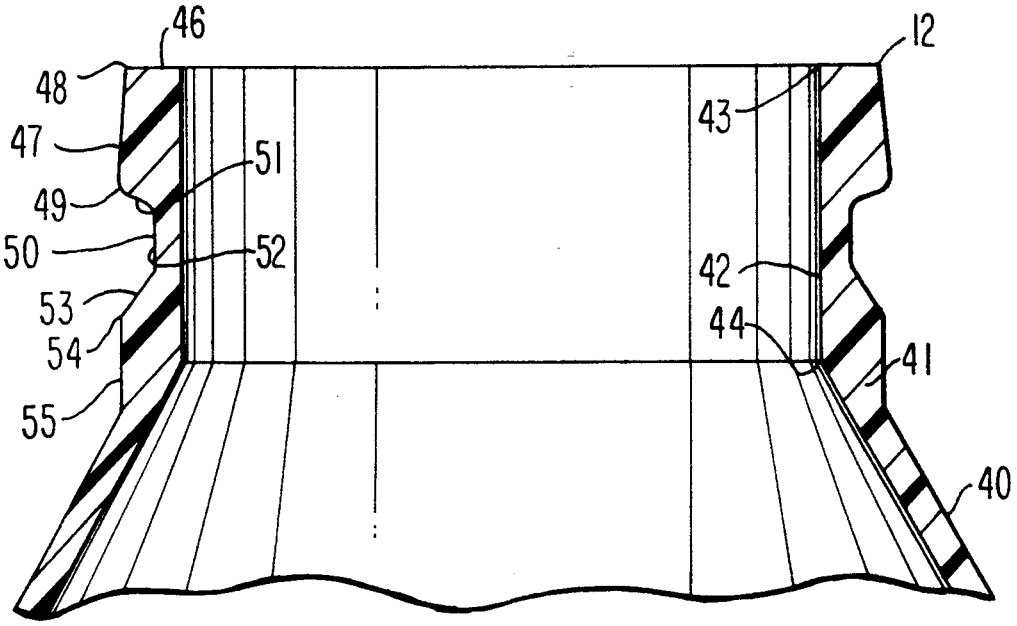
FIG. 2 is a vertical central sectional view of a container element forming another part of the embodiment.

In accordance with the invention, the device, generally indicated by reference character 10 comprises broadly: a closure element 11 (FIG. 1), and a container element 12 (FIG. 2).

The closure element 11 is most suitably formed as an injection molding from suitable synthetic resinous materials. We have found polypropylene to be particularly desirable because of high strength and resiliency per unit volume. It includes a generally planar end wall 20 and a cylindrical wall 21.

The end wall is bounded by an upper surface 24 and a lower surface 25 including an arcuate planar portion 26 and a centrally positioned domed surface 27. The wall 20 is bounded by an inner edge 28 and an outer edge 29.

The side wall 21 is bounded by a generally cylindrical outer surface 30 terminating in a thin lower edge 31 which is tapered to provide tamper indicating means. A frustoconical sealing surface 32 extends from the edge 28 to a lower edge 33, in turn immediately above an annular recess 34 which accommodates any flashing formed as a result of the container molding operation and forms a circular area of relatively thin cross section which enables spreading of the bead 35 when the closure is installed without initially distorting the frustoconical sealing surface 32. Below the recess 34 is an inwardly directed retaining bead 35 bounded by a rounded surface 36 and a tapered surface 37 which extends to a lower edge 38 above the edge 31.

The container element 12, as has been mentioned, is preferably formed from synthetic resinous materials, rather than glass, so that the neck portion 40 may possess a degree of resiliency. The portion 40 includes an upper cylindrical part 41 forming a cylindrical inner surface 42 terminating at an upper edge 43 and a lower edge 44 at which point the inner surface 42 becomes conical. Surrounding the upper edge 43 is an upper annular surface 46 which serves to position the closure when engaged, but which provides only a nominal sealing action. It may even form a narrow space between the closure and the end of the finish. Extending downwardly from the surface 46 is a frustoconical sealing surface adapted to mate with the surface 32 of the closure, which extends from an upper edge 48 to a lower edge 49. The degree of conicity may extend from as little as 2° to as much as 30°. However, we have found that a taper of approximately 5° with respect to the principal axis of the container is most effective from the standpoint of easy application of the closure upon the container finish, and high pressure on the mated sealing surfaces.

Extending below the sealing surfaces is a bead receiving recess 50 mounted by an upper surface 51, a cylindrical surface 52 and a lower surface 53 extending to an edge 54. Below the edge 54, the cylindrical surface 55 merges with the tapered portion of the neck of the container.

Figure 3:
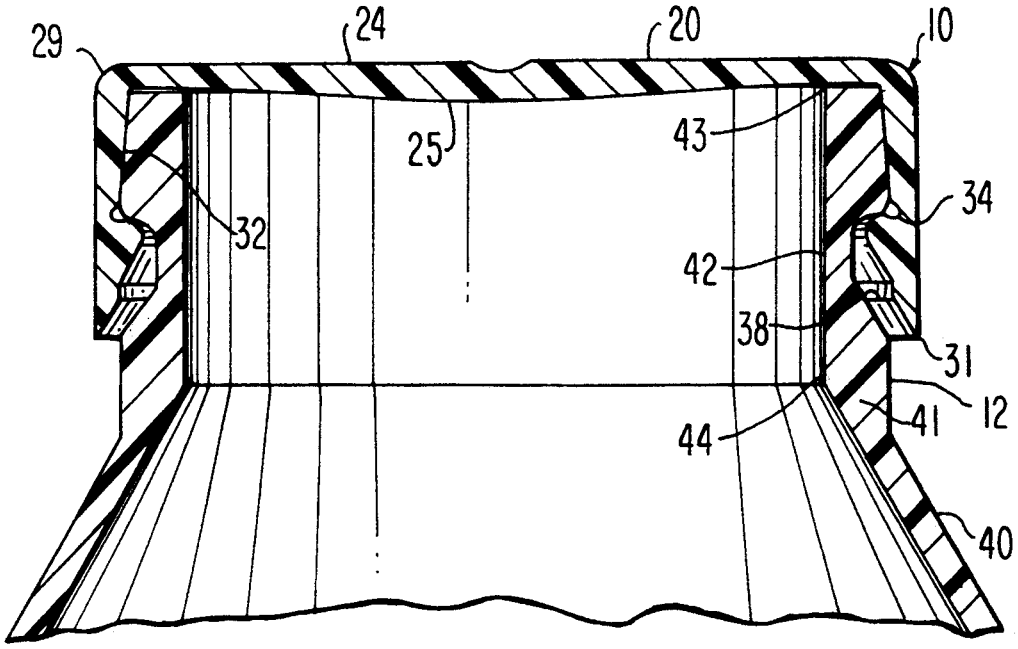
FIG. 3 is a vertical central sectional view showing the engagement of the closure element of FIG. 1 upon the container element shown in FIG. 2.

Because of the tapered configuration of the lower portion of the side wall of the closure, it may be formed using conventional molding techniques. The container element is most conveniently blow-molded from a preform in which the finish has already been precision molded with respect to its dimensions. Once the container is filled, the closure is applied using an axially directed force which spreads the side wall over the container finish until the position shown in FIG. 3 is reached. At this point, it will be observed that the surface 36 in cooperation with the recess 50 accurately position the closure, which, after positioning, is subjected to a small degree of radially directed stress. Because of the thinness of the planar end wall 20, the pressurized contents may exert a force on the domed portion 27 actually increasing the sealing pressure. This is equally true should a load be placed on the end wall of the closure, occurring, for example, during stacking of the containers. Any radial movement of the end wall should the container be dropped also does not affect the sealing action of the mating frustoconical surfaces.

Removal of the closure is accomplished in normal manner, using a known removal tool (not shown), which engages the lower edge of the side wall. It will be noted that such engagement will immediately distort the lower edge 31 to give clear evidence of any attempt at tampering. As the closure is removed, the side wall 21 will be distorted outwardly, immediately venting gaseous pressure within the container past the sealing surfaces, wherein the cap may be removed without explosive effect. Since the removal of the closure will not normally damage the container element, it may be conveniently recycled after use. It should be noted that a small flaw in either of the mating sealing surfaces that does not extend the full width thereof will not affect the sealing action.

We wish it to be understood that we do not consider the invention to be limited to the precise details of structure shown and set forth in the specification, for obvious modifications will occur to those skilled in the art to which the invention pertains.

We claim:

1. In combination, a container, and a synthetic resinous closure cap therefor, particularly suited for storing liquid contents under pressure; said container including a neck finish having an upper portion with an inner surface defining an opening, and an outer surface, said outer surface surrounding said opening and being of frusto-conical configuration forming a sealing area, a medially disposed portion of said outer surface defining a bead receiving recess; said closure including an end wall and a generally cylindrical side wall formed integrally therewith; said side wall defining a frusto-conical sealing surface corresponding to said sealing surface on said container finish adjacent said end wall and an inwardly projecting annular bead engageable with said bead retaining recess to resiliently maintain said closure upon said finish; said cap in engaged condition upon said container finish defining a clearance between an inner surface of said end wall and said outer surface of said finish wherein upon the presence of a load placed upon said end wall of said cap, said cap may radially expand in said sealing area to increase sealing pressure.

* * * * *